United States Patent [19]

Birke et al.

[11] 3,966,400

[45] June 29, 1976

[54] PROCESS AND DEVICE FOR THE IRREGULAR DYEING OF TEXTILES

[75] Inventors: Walter Birke; Hans-Ulrich von der Eltz; Franz Schön, all of Frankfurt am Main, Germany

[73] Assignee: Hoechst Aktiengesellschaft, Frankfurt am Main, Germany

[22] Filed: Aug. 22, 1974

[21] Appl. No.: 499,401

[30] Foreign Application Priority Data

Aug. 25, 1973 Germany ..... 2342981

[52] U.S. Cl. ..... 8/82; 8/14; 8/83; 8/85 R; 8/92; 8/93; 68/13 R; 96/66 T

[51] Int. Cl.[2] ..... C09B 67/00; D06C 23/00; D06P 5/02

[58] Field of Search ..... 8/82, 83, 92, 93, 85, 8/14, 12, 148, 149, 1 R, 32, 33, 51, 52, 53; 96/66 T; 68/13 R

[56] References Cited

UNITED STATES PATENTS

| | | | |
|---|---|---|---|
| 253,230 | 2/1882 | Sansone | 8/1 R |
| 1,527,446 | 2/1925 | Schiesari | 8/1 R |
| 2,928,712 | 3/1960 | Bradshaw | 8/85 |
| 3,248,219 | 4/1966 | Jacobs | 96/66 T |
| 3,716,330 | 2/1973 | Kitamura et al. | 8/93 |
| 3,726,640 | 4/1973 | Takriti et al. | 8/149 |

*Primary Examiner*—H.S. Cockeram
*Attorney, Agent, or Firm*—Curtis, Morris & Safford

[57] ABSTRACT

Process for the irregular dyeing of textile material, preferably in a continuous operation, by applying a mixture of dyestuffs and salts containing crystal water in powder form irregularly onto the material and melting the salt by means of a heat treatment, the bondage between the dyestuff and the material to be dyed being brought about by means of the liquid phase which forms thereby, and then finishing the dyeing in the usual manner according to known methods for the fixation of the dyestuffs used.

6 Claims, 1 Drawing Figure

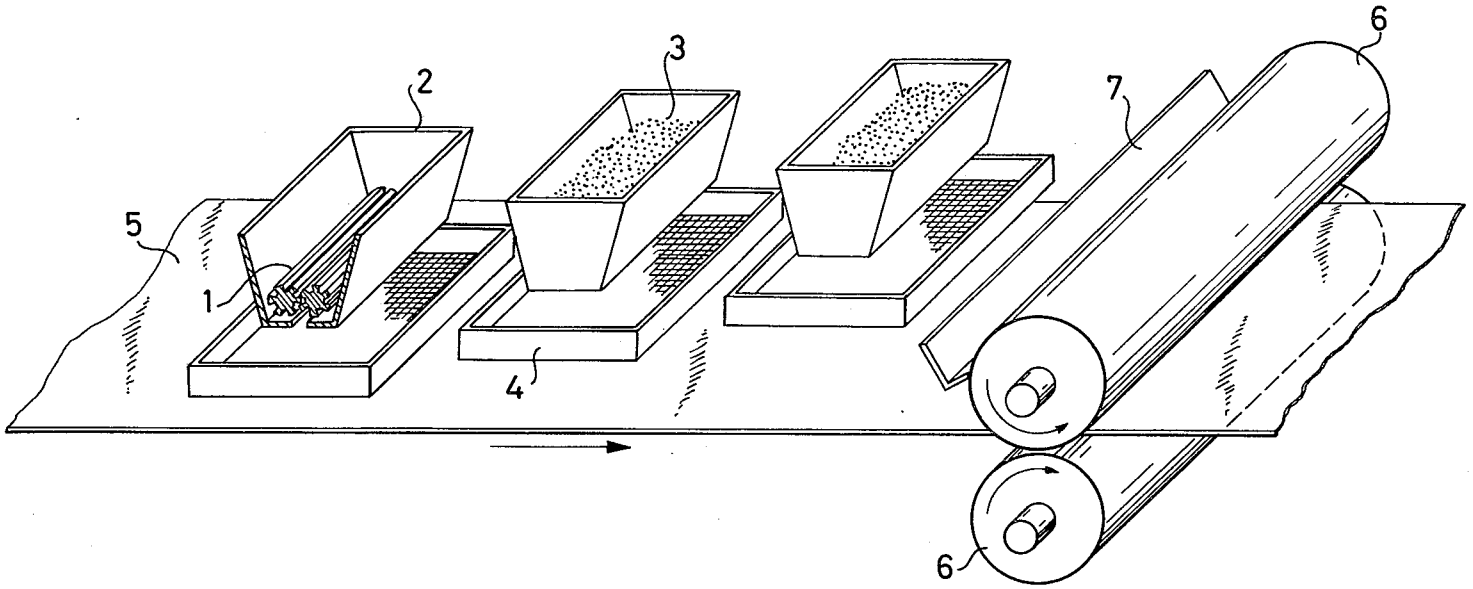
6
7
3
2
5
1
4
6

PROCESS AND DEVICE FOR THE IRREGULAR DYEING OF TEXTILES

The present invention relates to a process and a device for the irregular dyeing of textile material.

The irregular dyeing of textile material is already widely known from the literature of recent years. On principle, there is a difference between applying the dyes onto textiles in powder form and in liquid form. For example, German Auslegeschrift No. 2,122,714 discloses that textiles may be dyed in colored patterns by first applying dyes in powder form onto the material and then bonding them onto the material by means of liquid aids. Vice versa, it is also possible first to apply the liquid aid and then the dyestuff powder onto the textile. At any event, it is necessary to apply a solid and a liquid phase onto the material in at least two operations, the two phases taken together than being the "dyeing phase" on the fiber.

It has now been found that irregular dyeings can be produced on textile material in a simple and preferably continuous operation by irregularly applying a mixture of dyestuffs and salts containing crystal water in powder form onto the material and then heating them for a short time to temperatures above the melting point of each of the salts used, which melt below the softening point of the fiber, whereupon the dyestuff is bonded onto the material to be dyed by means of the liquid phase which then forms, and finally finishing the dyeing in the usual manner after known methods for the fixation of the dyestuffs used.

As dyestuffs, there may be used for the process of the invention any product suitable for the dyeing of textiles, alone or mixed with one another, depending on whether irregular effects are to be obtained in the same shade or in many shades. When fiber blends are used, it is also possible to obtain the cited effects using mixtures of dyestuffs of different dyestuff classes having the same shade or different shades. When coupling dyestuffs are used, it is also possible first to apply the one coupling component evenly onto the fibrous material in a conventional manner, for example by padding, and after the material has been dried, to apply the second dyestuff component onto the pretreated material according to the process of the invention.

According to the process of the invention, textiles made from all the known fibers of natural or synthetic origin or from fiber blends may be dyed irregularly. The textiles may be dyed in almost all the known processing forms, for example combed material, yarn, woven or knit fabrics or non-wovens. The process is preferably employed on textiles which are suitable for a continuous operation. According to the new process, it is also possible to produce colored patterns on textiles which have already been dyed.

As salts containing crystal water, there are preferably mentioned those salts which contain a high percentage of crystal water, for example Glauber's salt having 10 mols of water or disodium phosphate having 12 mols of water, and which are less hygroscopic. If certain chemical agents are required for the subsequent dyestuff fixation, these chemicals may already be considered for the composition of the dyestuff/salt mixture, for example trisodium phosphate or sodium borate for the application of reactive dyes.

The dyestuff/salt mixtures used according to the present invention may be prepared by various methods. In the simplest case, the dyestuff powder is mixed or ground with the salt containing crystal water. Salt, dyestuff and water may, however, also be pasted up first and excess water then removed therefrom by evaporation. This is of particular advantage in the case of dyestuffs available in a liquid water-containing dough or paste. In such a case, it may be advantageous for certain salts to be used in the calcined form and to contain the at least stoichiometric amount of water required for the formation of the crystallized salt, to be added separately or together with the dyestuff.

The mixing ratio of dyestuff to salt may vary greatly according to the process of the invention and depends on which effects are to be produced and in which form the dyestuffs are available, i.e., whether in a high concentration or in a dilute commercialized form.

The temperatures to be employed according to the invention in order to create the liquid phase necessary for the dyestuff/material bondage depend on the time of treatment and on the melting points of the salt or salt mixtures used and generally range from 50° to 150°C.

The process of the invention is operated by first applying the dyestuff/salt mixture irregularly onto the material to be dyed by appropriate strewing or screening devices. This operation is followed by a heat treatment at temperatures above the melting point of the salt or salt mixture used. This heat treatment is advantageously carried out using not hot air but contact heat, for example supplied by heated metal cylinders. In some cases, for example when a grinding operation is unsuitable owing to greatly varying particle size of the dyestuff powder and the crystallized salts, the dyestuffs and salts may also be applied separately by means of sieves or screens having different mesh width.

The dyestuff/salt mixture may contain, in addition to the dyestuffs and crystallized salts, aids and/or chemicals required for certain dyeing operations. In addition, it is also possible to use certain chemicals or resist agents in admixture with the crystallized salts, instead of the dyestuffs, if certain effects, for example white resist effects, are to be obtained on a dyed fabric.

After the strewed-on dyestuffs have been bonded to the material by means of the liquid phase formed during the heat treatment, they may be fixed, where required, by a treatment suitable for the dyestuffs used, preferably by a continuously operable treatment, for example steaming or application of chemicals and dwelling. The type of fixation treatment also assures different pattern or design effects, for example sharpoutlined patterns or designs obtained by a dry heat treatment and blurred designs obtained by a steaming or wet treatment operation.

The device of the present invention is shown diagrammatically by way of example in the accompanying drawing.

The unique FIGURE of this drawing shows a perspective view of one embodiment of this device. In this FIGURE, the device essentially consists of a spreading device for the powderized dyestuffs/salt mixture and an installation for the heating of the textile material to temperature above the melting points of the crystallized salts or salt mixture used. The spreading device may be, for example, a combined metering and screening device. A conveying screw or a pair of indented rollers 1 transports a metered amount of the dyestuff-/salt powder 3 from a storage container 2 onto a vibrating screen 4 which spreads the powder onto a fabric 5. The vibrating screen may also be divided into several sections parallelly and/or at right angles or obliquely to the transport direction of the textile material, each section of the screen being supplied separately by means of a metering device with the dyestuff/salt powder of different shades. In such a case, the vibrating screen and its metering devices arranged above it are suitably displaceable at right angles to the transport direction of the goods, which assures major modifications during designing. It is also possible to arrange several vibrating screens 4 with their corresponding metering devices above the material web 5 one beside or behind the other and to operate them at different metering and/or vibrating speeds. After the dyestuffs have been applied, the material is conducted across a heated metal surface or between two heated metal rollers 6 which heat the dyestuff/salt mixture applied above the melting point of the salts or mixture of salts used. The upper roller is suitably provided with a scraping edge 7 in order to remove dyestuff and salt particles adhering to the roller.

The following Examples illustrate the invention, the percentages being by weight.

EXAMPLE 1

10 Grams of the coupling component C.I. No. 37505 (Azoic Coupling Component 2) were dissolved in a mixture of 10 ml of ethanol, 5 ml of sodium hydroxide solution (of 32.5 % strength) and 15 ml of water (of 40°C) and the solution was then completed with water containing 5 ml/l of a 32.5 % sodium hydroxide solution to reach a volume of 1 liter. This solution was used to pad a cotton fabric on a padding machine at a liquor pick-up of about 70 % (calculated on the weight of the dry material) and then dried.

Then, a powder was applied onto the dried material by means of a screen. The powder had been prepared by mixing the following individual components:

75 % of crystallized Glauber's salt ($Na_2SO_4 \cdot 10\ H_2O$)

15 % of the diazo component C.I. No. 37105 (Azoic Diazo Component 12) and 10 % of the diazo component C.I. No. 37175 (Azoic Diazo Component 20).

The material thus treated was then passed between two metal rollers heated to 60°C, a temperature which assured that the total amount of salt applied was melted during the contact time of the fibrous material. The material was then rinsed first with acetic acid and then with a neutral medium and finished as usual by soaping it twice (at 60°C and at 95°C).

A fast dyeing was obtained having a red and blue pattern. A similar dyeing was obtained having blurred effects by rinsing the material for a short time until neutral, acidifying it and treating it as above.

EXAMPLE 2

A 2 % dyeing was first produced on a cotton fabric using the dyestuff of the formula

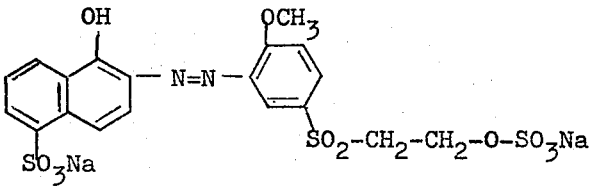

Then a powder was strewed onto this dyeing by means of a screen.

The powder had the following composition:

80 % of crystallized Glauber's salt ($Na_2SO_4 \cdot 10\ H_2O$) and

20 % of sodium dithionite.

The material was passed between two metal rollers heated to 50°–60°C, whereby the amount of salt applied was melted. The dyeing was then treated in water containing 5 ml/l of hydrogen peroxide (of 30 % strength), and finally rinsed.

A red dyeing having a white design was obtained.

EXAMPLE 3

A powder having the following composition was strewed onto a fabric made of polyester staple fibers by means of a screen:

70 % of crystallized Glauber's salt ($Na_2SO_4 \cdot 10\ H_2O$),

15 % of the dyestuff of the formula

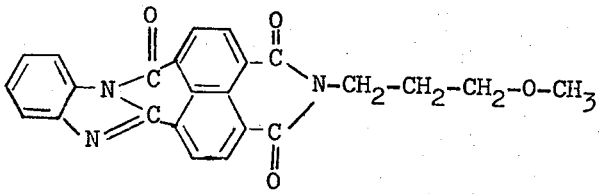

10 % of the dyestuff of the formula

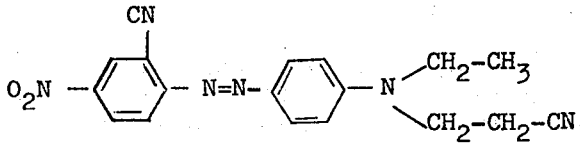

and 5 % of the dyestuff of the formula

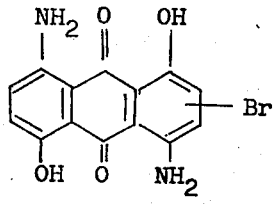

The fabric was then treated as described in the above Examples by means of metal rollers having a temperature of 60°C, then thermosoled for 1 minute at 210°C and finally cleaned by a reductive after-treatment. A multi-color design was obtained on the fabric.

EXAMPLE 4

A 2 % dyeing was first produced in the usual manner on a cotton fabric using the dyestuff C.I. No. 18852 (Reactive Yellow 17).

A powder of the following composition was then applied onto this dyeing by means of a screen:

20 % of crystallized sodium carbonate ($Na_2CO_3 \cdot 10\ H_2O$),

50 % of crystallized disodium tetraborate ($Na_2B_4O_7 \cdot 10\ H_2O$),

20 % of the dyestuff of the formula

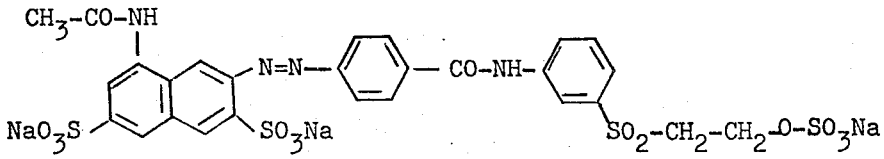

and 10 % of the dyestuff C.I. No. 61200 (Reactive Blue 19).

The fabric was then passed, as described above, between two metal rollers heated to 80°C, then fixed for 1 minute at 210°C and finally finished by washing it at the boil as usual for reactive dyestuffs. A multicolor pattern on a yellow bottom was obtained on the fabric.

EXAMPLE 5

Various screens were used to apply the following chemicals and dyestuffs successively onto a cotton fabric, the mixture applied to the material having approximately the following composition:

40 % of crystallized Glauber's salt ($Na_2SO_4 \cdot 10 H_2O$),

40 % of crystallized trisodium phosphate ($Na_3PO_4 \cdot 12 H_2O$,

18 % of the dyestuff C.I. No. 18852 (Reactive Yellow 17),

2 % of the dyestuff of the formula

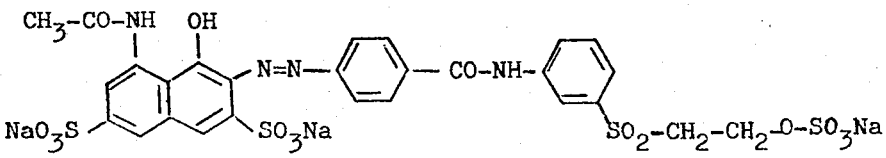

The material was then treated further as disclosed in Example 4.

A solid dyeing having a yellow/orange/red pattern was obtained.

EXAMPLE 6

A mixture of the following composition was applied onto a woollen fabric by means of a screen:

82 % of crystallized sodium acetate ($CH_3COONa \cdot 3 H_2O$),

12 % of the dyestuff C.I. No. 19025 (Acid Yellow 41),

3 % of the dyestuff C.I. No. 17070 (Acid Red 42) and

3 % of the sodium salt of dibutyl-naphthalene-sulfonic acid.

The woollen fabric was then passed between two metal rollers heated to 70°C and then treated for 2 to 3 minutes in water of about 95°C, which contained 20 ml/l of 90 % sulfuric acid. The goods were then rinsed with hot and cold water. A multi-color pattern dyeing having greatly blurred effects was obtained.

EXAMPLE 7

The following mixture was strewed by means of a screen onto a blended fabric of 67 % of polyester fibers and 33 % of cotton:

70 % of crystallized Glauber's salt ($Na_2SO_4 \cdot H_2O$)

18 % of the dyestuff C.I. No. 18852 (Reactive Yellow 17)

8 % of the dyestuff of the formula

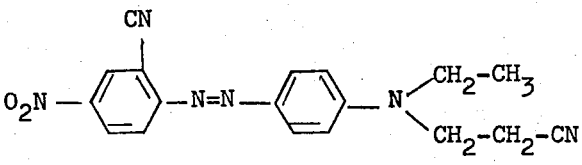

and 4 % of the dyestuff of the formula

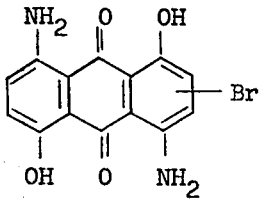

The blended fabric was then passed between two metal rollers heated to 60°C, thermosoled for 1 minute at 210°C and finally sprayed with an aqueous solution (pick-up of about 70 % of the material weight), which contained 200 g/l of sodium chloride and 30 ml/l of a 32.5 % sodium hydroxide solution. The material was then batched up, allowed to dwell overnight at room temperature, then rinsed with hot and cold water and finally finished by soaping it at the boil with an aqueous solution of 1 g/l of a non-ionic detergent.

A patterned dyeing was obtained having sharp-standing red and blue spots and slightly blurred yellow spots.

We claim:

1. A process for the irregular dyeing of textile material, which comprises: applying a mixture of dyestuffs and salts containing crystal water in powder form irregularly onto the material and melting the salt by means of a heat treatment sufficient to melt and release water from said salts, the bondage between the dyestuffs and the material to be dyed being brought about by means of the liquid phase which forms thereby; and then finishing the dyeing in the usual manner according to known methods for the fixation of the dyestuffs used.

2. A process as claimed in claim 1, wherein the dyestuffs and salts containing crystal water are applied onto the material separately in powder form in any succession desired.

3. A process as claimed in claim 1, wherein in admixture with the dyestuff salt combination, chemicals or aids necessary for the fixation of the dyestuffs are applied onto the material.

4. A process as claimed in claim 1, wherein the textile material is a predyed material.

5. A process for the irregular dyeing of textile material, which comprises applying a mixture of a resist agent or chemical which destroys dyestuff and salts containing crystal water in powder form onto a predyed textile material and then heating the mixture in contact with said material to melt and release water from said salts.

6. A process as recited in claim 1, werein one component of a coupling dyestuff is first applied evenly to the material and a second component is applied irregularly in admixture with said salts in powder form, for producing a pattern or design.

* * * * *